US007380543B2

(12) United States Patent
Hatano et al.

(10) Patent No.: US 7,380,543 B2
(45) Date of Patent: Jun. 3, 2008

(54) FUEL VAPOR RELEASE SUPPRESSION SYSTEM FOR FUEL TANK

(75) Inventors: Gaku Hatano, Saitama (JP); Koichi Hidano, Saitama (JP); Masakazu Kitamoto, Saitama (JP); Shigeo Hidai, Saitama (JP); Shoji Uhara, Saitama (JP); Hiroshi Kitamura, Saitama (JP); Takahiro Imamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/605,930

(22) Filed: Nov. 28, 2006

(65) Prior Publication Data

US 2007/0151610 A1 Jul. 5, 2007

(30) Foreign Application Priority Data

Dec. 27, 2005 (JP) ..... 2005-376027

(51) Int. Cl.
*F02M 17/20* (2006.01)
*F02M 17/22* (2006.01)

(52) U.S. Cl. ..... 123/519; 123/461

(58) Field of Classification Search ..... 123/519, 123/518, 520, 509, 516, 461; 137/571, 565.17
See application file for complete search history.

(56) References Cited

U.S. PATENT DOCUMENTS 5,740,784 A * 4/1998 McKinney ..... 123/509
6,553,974 B1 * 4/2003 Wickman et al. ..... 123/516
6,694,955 B1 * 2/2004 Griffiths et al. ..... 123/516
6,718,953 B1 * 4/2004 Torgerud ..... 123/516

FOREIGN PATENT DOCUMENTS

JP 2000-045889 2/2000
JP 3659005 3/2005

* cited by examiner

*Primary Examiner*—Mahmoud Gimie
(74) *Attorney, Agent, or Firm*—Carrier, Blackman & Associates, P.C.; Joseph P. Carrier; William D. Blackman

(57) ABSTRACT

In a fuel vapor release suppression system for a fuel tank, a main tank and a sub tank communicate with each other, and the sub tank and a canister communicate with each other. When the main tank has a higher temperature, fuel vapor of the main tank is supplied to the sub tank where the fuel vapor is liquefied. When the main tank has a lower temperature, fuel vapor of the sub tank is supplied to the main tank. At this time, low concentration fuel vapor is supplied from the canister to the main tank, thereby accelerating generation of fuel vapor corresponding to sub tank fuel vapor pressure, so that the sub tank fuel vapor pressure decreases. Therefore, liquefaction is accelerated in the sub tank when the main tank temperature increases. Thus, fuel vapor generated in a fuel tank is effectively liquified irrespective of ambient air temperature.

21 Claims, 5 Drawing Sheets

FUEL VAPOR RELEASE SUPPRESSION SYSTEM FOR FUEL TANK

CROSS-REFERENCE TO RELATED APPLICATIONS

The present invention claims priority under 35 USC 119 based on Japanese patent application No. 2005-376027, filed on Dec. 27, 2005. The subject matter of this priority document is incorporated by reference herein.

BACKGROUND OF INVENTION

1. Field of the Invention

The present invention relates to a fuel vapor release suppression system for a fuel tank, in which a main tank and a sub tank communicate with each other via a communication passage, and the sub tank and a canister communicate with each other via a charge passage.

2. Description of Related Art

Japanese Patent Publication No. 3659005 discloses an automobile fuel tank arrangement wherein a sub tank is provided separately from a main tank, and is placed in a low temperature environment as compared with the main tank. In this arrangement, fuel vapor is supplied from a gas-phase portion of the main tank, having a higher temperature, to a liquid-phase portion of the sub tank, having a lower temperature, and is liquefied therein. In addition, the liquefied fuel is returned to the main tank, thereby reducing the load on a canister that is charged with fuel vapor and lowering the concentration of fuel vapor that is purged from the canister into an intake passage of an engine to reduce the influence on combustion of the engine.

In this conventional arrangement, fuel vapor generated in the main tank can be liquefied in the sub tank when the temperature of the sub tank is lower than that of the main tank, but the fuel vapor cannot be liquefied when the temperature of the sub tank is higher than that of the main tank. Therefore, in order to enable constant fuel vapor liquefaction, the temperature of the sub tank is required to be lowered by using a cooling device, leading to a problem that the power consumed by the cooling system imposes a burden on the vehicle battery.

SUMMARY OF THE INVENTION

The present invention has been accomplished under the above-mentioned circumstances, and it is an object thereof to effectively liquefy fuel vapor generated in a fuel tank irrespective of ambient air temperature.

In order to achieve the above object, according to a first feature of the present invention, there is provided a fuel vapor release suppression system for a fuel tank, comprising: a main tank; a sub tank; a communication passage for providing communication between the main tank and the sub tank; a canister; and a charge passage for providing communication between the sub tank and the canister. The communication passage includes a first communication passage for providing communication between a gas-phase portion of the main tank and a liquid-phase portion of the sub tank, and a second communication passage for providing communication between a gas-phase portion of the sub tank and a liquid-phase portion of the main tank.

With the first feature of the present invention, the communication passage, which provides communication between the main tank and the sub tank, is formed of both the first communication passage, providing communication between the gas-phase portion of the main tank and the liquid-phase portion of the sub tank, and the second communication passage, providing communication between the gas-phase portion of the sub tank and the liquid-phase portion of the main tank. In addition, the sub tank and the canister communicate with each other via the charge passage. Therefore, when the temperature of the main tank increases, the number of moles of the gaseous mixture of air and fuel vapor that can be present in the gas-phase portion of the main tank decreases, and at the same time fuel vapor generated from the liquid-phase portion enters the gas-phase portion with an increase in the fuel vapor pressure, so that the gaseous mixture of air and fuel vapor in the gas-phase portion of the main tank is supplied to the liquid-phase portion of the sub tank via the first communication passage. In the gaseous mixture of air and fuel vapor supplied to the sub tank, the partial pressure of the fuel vapor is higher than the fuel vapor pressure within the sub tank, and thus fuel vapor corresponding to the difference liquefies in the liquid-phase portion of the sub tank.

Further, when the temperature of the main tank decreases, the number of moles of the gaseous mixture of air and fuel vapor that can be present in the gas-phase portion of the main tank increases, and at the same time the fuel vapor in the gas-phase portion liquefies in the liquid-phase portion with a decrease in the fuel vapor pressure, so that the gaseous mixture of air and fuel vapor is supplied from the gas-phase portion of the sub tank to the liquid-phase portion of the main tank via the second communication passage. In this process, a gaseous mixture of air and fuel vapor having a relatively low fuel vapor concentration is supplied from the canister to the gas-phase portion of the sub tank, thereby accelerating generation of fuel vapor from the liquid-phase portion corresponding to the fuel vapor pressure of the sub tank, so that the composition of fuel components changes to cause the so-called 'drying-up', and the fuel vapor pressure of the sub tank decreases. Therefore, liquefaction is accelerated in the liquid-phase portion of the sub tank when the temperature of the main tank increases.

As described above, when the temperature of the main tank increases, the fuel vapor is liquefied in the sub tank; whereas when the temperature of the main tank decreases, the fuel vapor is liquefied in the main tank and the fuel vapor pressure of the sub tank is decreased. Therefore, the next time the temperature of the main tank increases, liquefaction of fuel vapor can be accelerated in the sub tank.

According to a second feature of the present invention, there is provided a fuel vapor release suppression system for a fuel tank, comprising: a main tank; a sub tank; a communication passage for providing communication between the main tank and the sub tank; a canister; and a charge passage for providing communication between the sub tank and the canister. The communication passage includes a first communication passage for providing communication between a gas-phase portion of the main tank and a liquid-phase portion of the sub tank, and a second communication passage for providing communication between a gas-phase portion of the sub tank and a gas-phase portion of the main tank. The second communication passage comprises a check valve for preventing fuel vapor from flowing from the gas-phase portion of the main tank back to the gas-phase portion of the sub tank.

With the second feature of the present invention, the communication passage providing communication between the main tank and the sub tank is formed of both the first communication passage, providing communication between the gas-phase portion of the main tank and the liquid-phase portion of the sub tank, and the second communication passage, providing communication between the gas-phase portion of the sub tank and the gas-phase portion of the main tank. In addition, the sub tank and the canister communicate with each other via the charge passage. Therefore, when the temperature of the main tank increases, the number of moles of the gaseous mixture of air and fuel vapor that can be present in the gas-phase portion of the main tank decreases, and at the same time fuel vapor generated from the liquid-phase portion enters the gas-phase portion with an increase in the fuel vapor pressure, so that the gaseous mixture of air and fuel vapor in the gas-phase portion of the main tank is supplied to the liquid-phase portion of the sub tank via the first communication passage. In the gaseous mixture of air and fuel vapor supplied to the sub tank, the partial pressure of the fuel vapor is higher than the fuel vapor pressure within the sub tank, and thus fuel vapor corresponding to the difference liquefies in the liquid-phase portion of the sub tank.

Further, when the temperature of the main tank decreases, the number of moles of the gaseous mixture of air and fuel vapor that can be present in the gas-phase portion of the main tank increases, and at the same time the fuel vapor in the gas-phase portion liquefies in the liquid-phase portion with a decrease in the fuel vapor pressure, so that the gaseous mixture of air and fuel vapor is supplied from the gas-phase portion of the sub tank to the gas-phase portion of the main tank via the second communication passage. In this process, a gaseous mixture of air and fuel vapor having a relatively low fuel vapor concentration is supplied from the canister to the gas-phase portion of the sub tank, thereby accelerating generation of fuel vapor from the liquid-phase portion corresponding to the fuel vapor pressure of the sub tank, so that the composition of fuel components changes to cause the so-called 'drying-up', and the fuel vapor pressure of the sub tank decreases. Therefore, liquefaction is accelerated in the liquid-phase portion of the sub tank when the temperature of the main tank increases.

As described above, when the temperature of the main tank increases, the fuel vapor is liquefied in the sub tank; whereas when the temperature of the main tank decreases, the fuel vapor is liquefied in the main tank and the fuel vapor pressure of the sub tank is decreased. Therefore, the next time the temperature of the main tank increases, liquefaction of fuel vapor can be accelerated in the sub tank. In this process, the check valve provided in the second communication passage can prevent backflow of fuel vapor from the gas-phase portion of the main tank to the gas-phase portion of the sub tank.

According to a third feature of the present invention, in addition to the first or second feature, the sub tank has a structure with a heat transfer rate that is lower than that of the main tank.

With the third feature of the present invention, since the sub tank has a structure with a heat transfer rate that is lower than that of the main tank, when the ambient air temperature increases, the temperature of the main tank becomes higher than the temperature of the sub tank, and when the ambient air temperature decreases, the temperature of the sub tank becomes higher than the temperature of the main tank, thereby effectively liquefying fuel vapor in both the main tank and the sub tank.

According to a fourth feature of the present invention, in addition to the third feature, at least a part of the sub tank is covered by any one of a heat-insulating material, a heat-storing material, and a vacuum heat-insulating layer.

With the fourth feature of the present invention, since at least one part of the sub tank is covered with at least one of a heat-insulating material, a heat-storing material, and a vacuum heat-insulating layer, the heat transfer coefficient of the sub tank can be made smaller than the heat transfer coefficient of the main tank.

According to a fifth feature of the present invention, in addition to the third or fourth feature, the sub tank is disposed in the interior of the main tank.

With the fifth feature of the present invention, since the sub tank is disposed in the interior of the main tank, when the ambient air temperature increases, the temperature of the main tank can be made higher than the temperature of the sub tank, and when the ambient air temperature decreases, the temperature of the sub tank can be made higher than the temperature of the main tank. Further, the sub tank is integrated in the main tank, thus reducing the overall size of the entire fuel tank, reducing the number of steps in assembling the fuel tank to a vehicle body, and improving the degree of freedom in the layout.

According to a sixth feature of the present invention, in addition to any of the first to fifth features, a fuel level of the sub tank is set to be higher than a fuel level of the main tank; and a height from the fuel level of the main tank to the fuel level of the sub tank is set to be larger than a height at which the first communication passage is submerged under the fuel level of the sub tank.

With the sixth feature, the fuel level of the sub tank is made higher than the fuel level of the main tank, and the height from the fuel level of the main tank to the fuel level of the sub tank is set to be larger than the height at which the first communication passage is submerged under the fuel level of the sub tank. Therefore, it is possible to supply fuel vapor from the main tank to the sub tank via the first communication passage, while preventing backflow of fuel from the main tank to the sub tank via the second communication passage.

According to a seventh feature of the present invention, in addition to the sixth feature, the fuel level of the main tank is a full tank level.

With the seventh feature of the present invention, since the fuel level of the main tank in the arrangement of the sixth feature is the full tank level, even when the tank is full to provide the most severe condition, it is possible to set the height from the fuel level of the main tank to the fuel level of the sub tank to be larger than the height at which the second communication passage is submerged under the fuel level of the sub tank.

According to an eighth feature of the present invention, in addition to any of the first to seventh features, the fuel level of the sub tank is set to be higher than the fuel level of the main tank; and a height from an opening portion of the second communication passage in the main tank to the fuel level of the main tank is set to be smaller than a height from the fuel level of the sub tank to the highest portion of the first communication passage.

With the eighth feature of the present invention, the fuel level of the sub tank is set to be higher than the fuel level of the main tank, and the height from the opening portion of the second communication passage in the main tank to the fuel level of the main tank is set to be smaller than the height from the fuel level of the sub tank to the highest portion of the first communication passage. Therefore, it is possible to supply fuel vapor from the sub tank to the main tank via the second communication passage, while preventing backflow of fuel from the sub tank to the main tank via the first communication passage.

According to a ninth feature of the present invention, in addition to any of the first to seventh features, the fuel level of the sub tank is set to be higher than the fuel level of the main tank; a height from an opening portion of the second communication passage in the main tank to the fuel level of the main tank is allowed to become larger than a height from the fuel level of the sub tank to the highest portion of the first communication passage; and the first communication passage comprises a check valve for restricting inflow of fuel from the sub tank to the main tank.

With the ninth feature of the present invention, the fuel level of the sub tank is set to be higher than the fuel level of the main tank, and even if the height from the opening portion of the second communication passage in the main tank to the fuel level of the main tank is set to be larger than the height from the fuel level of the sub tank to the highest portion of the first communication passage for convenience of layout, it is possible to supply fuel vapor from the sub tank to the main tank via the second communication passage while preventing backflow of fuel from the sub tank to the main tank via the first communication passage by virtue of the check valve that is provided in the first communication passage in order to restrict the inflow of fuel from the sub tank to the main tank.

According to a tenth feature of the present invention, in addition to the eighth or ninth feature, height of the opening portion of the second communication passage in the main tank is made variable.

With the tenth feature of the present invention, the height of the opening portion of the second communication passage in the main tank is made variable, and even if the fuel level of the main tank changes, it is possible to set the height from the opening portion of the second communication passage in the main tank to the fuel level of the main tank to be smaller than the height from the fuel level of the sub tank to the highest portion of the first communication passage.

According to an eleventh feature of the present invention, in addition to any of the first to tenth features, wherein volume of the sub tank between an opening portion of the first communication passage in the sub tank and the opening portion of the second communication passage is set to be larger than volume for drawing out fuel from the sub tank to the main tank via the first communication passage.

With the eleventh feature of the present invention, the volume of the sub tank between the opening portion of the first communication passage in the sub tank and the opening portion of the second communication passage in the sub tank is set to be larger than the volume of fuel that is drawn out from the sub tank to the main tank via the first communication passage. Therefore, when the temperature of the main tank becomes lower than the temperature of the sub tank and fuel within the sub tank flows back into the main tank via the first communication passage, it is possible to prevent the fuel level of the sub tank from decreasing below the opening portion of the first communication passage thus making it impossible to supply fuel vapor from the sub tank to the liquid-phase portion of the main tank when the temperature decreases, or to supply fuel vapor from the main tank to the liquid-phase portion of the sub tank when the temperature increases.

According to a twelfth feature of the present invention, in addition to any of the first to eleventh features, a filler tube extending upward from the main tank is connected, at a portion near a filler hole provided at an upper end of the filler tube, to the gas-phase portion of the main tank via a fuel vapor return passage; and the first communication passage is connected to the fuel vapor return passage.

With the twelfth feature of the present invention, since the first communication passage is connected to the fuel vapor return passage connecting the portion of the filler tube near the filler hole provided at an upper end of the filler tube to the gas-phase portion of the main tank. Therefore, the height from the fuel level of the sub tank to the highest portion of the first communication passage is increased, and at the same time the length of the first communication passage is reduced by utilizing the fuel vapor return passage as a part of the first communication passage.

According to a thirteenth feature of the present invention, in addition to any of the first to eleventh features, the sub tank is replenished via a fuel replenishment passage with at least a part of surplus fuel supplied from the main tank to an engine.

With the thirteenth feature of the present invention, since the sub tank is replenished, via the fuel replenishment passage, with surplus fuel supplied from the main tank to the engine, it is possible to prevent the fuel level of the sub tank from decreasing and also prevent the fuel within the sub tank from deteriorating due to aging.

According to a fourteenth feature of the present invention, in addition to the first feature, a fuel level of the sub tank is set to be lower than a fuel level of the main tank, and the fuel vapor release suppression system further comprises a check valve that is provided in the second communication passage and restricts inflow of fuel from the main tank to the sub tank. In addition, a float valve is provided at an exit of a fuel replenishment passage for supplying fuel from the main tank to the sub tank which restricts an upper limit of the fuel level of the sub tank, a jet pump is operated by surplus fuel supplied from the main tank to an engine, a fuel discharge passage is provided that draws up surplus fuel from the sub tank to the main tank by means of the jet pump, and a check valve is provided in the fuel discharge passage and restricts the inflow of fuel from the main tank to the sub tank.

With the fourteenth feature of the present invention, the check valve is provided in the second communication passage, restricting the inflow of fuel from the main tank side to the sub tank side. In addition, the float valve is provided in the exit of the fuel replenishment passage for supplying fuel from the main tank to the sub tank, restricting the upper limit of the fuel level of the sub tank, the jet pump operates by surplus fuel supplied from the main tank to the engine, the fuel discharge passage draws surplus fuel from the sub tank to the main tank by means of the jet pump, and the check valve is provided in the fuel discharge passage, restricting the inflow of fuel from the main tank side to the sub tank side. Therefore, even if the fuel level of the sub tank is set to be lower than the fuel level of the main tank, liquefaction of fuel vapor can be carried out without any problem, thereby improving the degree of freedom in layout of the sub tank.

The above-mentioned object, other objects, characteristics, and advantages of the present invention will become apparent from preferred embodiments that will be described in detail below by reference to the attached drawings.

DETAILED DESCRIPTION

Figure 1:
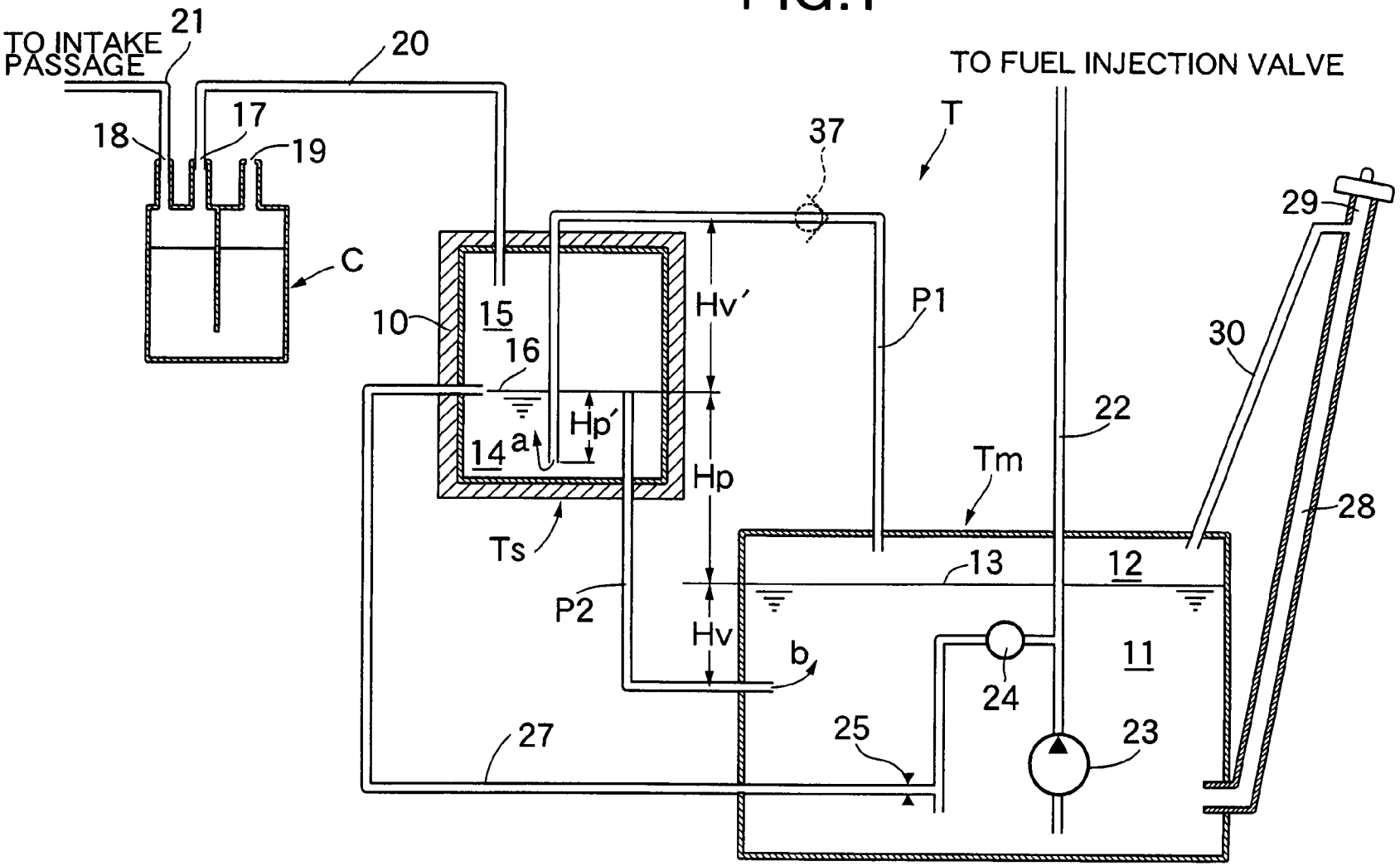
FIG. 1 is a diagram showing a fuel vapor release suppression system for a fuel tank according to a first embodiment.

FIG. 1 shows the first embodiment of the present invention. A fuel tank T of an automobile includes a main tank Tm and a sub tank Ts. The sub tank Ts, having a volume smaller than that of the main tank Tm, is disposed at a position higher than the main tank Tm. The periphery of the sub tank Ts is covered by a heat-insulating material 10. The interior of the main tank Tm is divided into a liquid-phase portion 11 filled with fuel and a gas-phase portion 12 filled with fuel vapor. When a fuel level 13 in the main tank Tm changes due to replenishment or consumption of fuel, the volume of the liquid-phase portion 11 and the volume of the gas-phase portion 12 change. The interior of the sub tank Ts is divided into a liquid-phase portion 14 filled with fuel and a gas-phase portion 15 filled with fuel vapor. A fuel level 16 in the sub tank Ts is basically constant. The gas-phase portion 12 of the main tank Tm and the liquid-phase portion 14 of the sub tank Ts are connected via a first communication passage P1. The gas-phase portion 15 of the sub tank Ts and the liquid-phase portion 11 of the main tank Tm are connected via a second communication passage P2.

A canister C capable of adsorbing fuel vapor includes a charge port 17, a purge port 18, and a drain port 19. The charge port 17 is connected to the gas-phase portion 15 of the sub tank Ts via a charge passage 20. The purge port 18 is connected to an intake passage (not illustrated) of an engine via a purge passage 21. The drain port 19 is open to the atmosphere.

A fuel pump 23 is disposed within the main tank Tm. The fuel pump 23 supplies fuel to an engine fuel injection valve (not illustrated) via a feed pipe 22. A fuel replenishment passage 27, which branches from an intermediate portion of the feed pipe 22 and passes through a pressure regulator 24, is connected to the sub tank Ts. An orifice 25 is formed in the fuel replenishment passage 27. A majority of fuel that has passed through the pressure regulator 24 is returned to the main tank Tm, but part thereof is supplied to the sub tank Ts through the orifice 25.

The height at which the fuel replenishment passage 27 opens in the sub tank Ts is set to be a height at which the second communication passage P2 opens in the sub tank Ts, and this height becomes the height of the fuel level 16 of the sub tank Ts. The height at which the fuel replenishment passage 27 opens in the sub tank Ts may be higher than the height at which the second communication passage P2 opens in the sub tank Ts.

A filler tube 28 extends upward from the main tank Tm. A filler hole 29 is provided in an upper end of the filler tube 28. A portion of the filler tube 28 near the filler hole 29 is connected to the gas-phase portion 12 of the main tank Tm via a fuel vapor return passage 30. The fuel vapor return passage 30 functions to prevent external air from being taken into the main tank Tm when fuel is supplied to the filler tube 28 via the filler hole 29 by means of a fuel supply gun, by returning fuel vapor of the gas-phase portion 12 of the main tank Tm to the vicinity of the filler hole 29 and then returning this fuel vapor to the interior of the main tank Tm together with fuel injected from the fuel supply gun.

The fuel level 16 of the sub tank Ts is higher than the fuel level 13 of the main tank Tm when the main tank Tm is full. A height Hp from the fuel level 13 of the main tank Tm to the fuel level 16 of the sub tank Ts is set to be larger than a height Hp' at which the first passage P1 is submerged under the fuel level 16 of the sub tank Ts.

Further, a height Hv from an opening portion of the second communication passage P2 in the main tank Tm to the fuel level 13 of the main tank Tm is set to be smaller than a height Hv' from the fuel level 16 of the sub tank Ts to the highest portion of the first communication passage P1.

The operation of the first embodiment of the present invention having the above-described arrangement is now described.

The temperature of the fuel tank T increases as the ambient air temperature increases during the daytime, and the temperature of the main tank Tm becomes higher than the temperature of the sub tank Ts covered by the heat-insulating material 10, so that the number of moles of the gaseous mixture of air and fuel vapor that can be present in the gas-phase portion 12 of the main tank Tm decreases, and at the same time fuel vapor generated from the liquid-phase portion 11 enters the gas-phase portion 12 of the main tank Tm with an increase in the fuel vapor pressure. As a result, the gaseous mixture of air and fuel vapor of the gas-phase portion 12 of the main tank Tm is released as bubbles into the liquid-phase portion 14 of the sub tank Ts via the first communication passage P1 (see Arrow a). Since the partial pressure of fuel vapor supplied from the main tank Tm is higher than the partial pressure of fuel vapor present in the sub tank Ts, a portion corresponding to the difference liquefies and dissolves in the liquid-phase portion 14 of the sub tank Ts. Therefore, of the fuel vapor generated in the gas-phase portion 12 of the main tank Tm, the proportion of fuel vapor charged via the charge passage 20 into the canister C is decreased, so that it is possible to downsize the canister C.

The temperature of the fuel tank T decreases as the ambient air temperature decreases during the night and the temperature of the main tank Tm becomes lower than the temperature of the sub tank Ts covered by the heat-insulating material 10, so that the number of moles of gaseous mixture that can be present in the gas-phase portion 12 of the main tank Tm increases, and at the same time fuel vapor liquefies from the gas-phase portion 12 into the liquid-phase portion 11 of the main tank Tm with a decrease in the fuel vapor pressure. As a result, the gaseous mixture of the gas-phase portion 15 of the sub tank Ts is introduced into the liquid-phase portion 11 of the main tank Tm via the second communication passage P2.

As described above, when the negative pressure generated in the gas-phase portion 12 of the main tank Tm draws fuel vapor of the gas-phase portion 15 of the sub tank Ts, the so-called back purge becomes possible, that is, fuel vapor that has been charged into the canister C can be purged by external air taken in via the drain port 19 of the canister C; the fuel vapor thus purged flows into the gas-phase portion 15 of the sub tank Ts via the charge passage 20; and is returned therefrom to the liquid-phase portion 11 of the main tank Tm and is liquefied therein. Since the above-described back purge is carried out when the engine is stopped, the amount (weight) of fuel vapor charged into the canister C can be reduced to a low level. Therefore, in purging fuel vapor from the canister C to the intake passage of the engine when the engine is running, the amount of fuel vapor is reduced in the purge air, thereby minimizing influence on the accuracy in control of the air-fuel ratio of the engine.

Since the gaseous mixture supplied from the canister C to the gas-phase portion 15 of the sub tank Ts by the above-described back purge has a relatively low concentration of fuel vapor, there occurs a phenomenon (the so-called drying-up) in which generation of fuel vapor from the liquid-phase portion 14 is accelerated corresponding to the fuel vapor pressure of the gas-phase portion 15 of the sub tank Ts to change the composition of fuel components, so that the fuel vapor pressure of the gas-phase portion 15 of the sub tank Ts decreases. In the case where the fuel vapor pressure of the gas-phase portion 15 of the sub tank Ts decreases in this way, liquefaction of fuel vapor supplied from the main tank Tm to the sub tank Ts can be more effectively accelerated when the temperature of the main tank Tm increases.

The above-described back purge occurs also in a conventional fuel tank without a sub tank, but in that case the amount of fuel vapor dissolving in the liquid-phase portion of the fuel tank becomes relatively small because fuel vapor having a relatively low concentration purged from the canister is supplied to the fuel tank. In contrast, in this embodiment, the amount of fuel vapor collected by being dissolved in the liquid-phase portion 11 of the main tank Tm becomes relatively large because the fuel vapor purged from the canister C increases its concentration while being supplied via the sub tank Ts to the main tank Tm.

If the fuel level 16 of the sub tank Ts is lower than the open end of the first communication passage P1, fuel vapor supplied from the main tank Tm via the first communication passage P1 cannot be introduced directly to the liquid-phase portion 14 of the sub tank Ts, and fuel in the liquid-phase portion 14 cannot be returned to the main tank Tm via the second communication passage P2, leading to a possibility that the fuel ages and the composition of its components changes. Therefore, in order to avoid such a situation, fresh fuel is supplied from the fuel pump 23 to the sub tank Ts via the regulator 24 and the fuel replenishment passage 27. If the fuel level 16 of the sub tank Ts becomes higher than the opening portion at the upper end of the second communication passage P2 due to fuel supplied from the fuel replenishment passage 27, surplus fuel is returned to the main tank Tm via the second communication passage P2, thereby constantly maintaining the fuel level 16 of the sub tank Ts at a certain level.

In the first embodiment, the height Hp from the fuel level 13 of the main tank Tm to the fuel level 16 of the sub tank Ts is set to be larger than the height Hp' at which the first communication passage P1 is submerged under the fuel level 16 of the sub tank Ts. The technical significance of this arrangement is described below.

In order to supply fuel vapor from the gas-phase portion 12 of the main tank Tm to the liquid-phase portion 14 of the sub tank Ts via the first communication passage P1, difference in pressure between the gas-phase portion 12 of the main tank Tm and the gas-phase portion 15 of the sub tank Ts is required to be larger than the pressure of a column of fuel having a height Hp'. However, if the difference in pressure between the gas-phase portion 12 of the main tank Tm and the gas-phase portion 15 of the sub tank Ts is larger than the pressure of a column of fuel having a height of Hp, fuel of the main tank Tm flows back to the sub tank Ts via the second communication passage P2. Therefore, Hp>Hp' is required to be established in order to supply fuel vapor from the main tank Tm to the sub tank Ts while preventing fuel from flowing from the main tank Tm back to the sub tank Ts.

The height Hp from the fuel level 13 of the main tank Tm to the fuel level 16 of the sub tank Ts changes corresponding to the fuel level 13 of the main tank Tm, and the fuel level 13 is highest when the main tank Tm is full. Therefore, if the heights are set so that Hp>Hp' holds when the main tank Tm is full, fuel vapor is supplied from the main tank Tm to the sub tank Ts however the level of the main tank Tm changes.

If Hp>Hp' does not hold when the fuel level 13 of the main tank Tm reaches a certain height, it becomes impossible to supply fuel vapor from the main tank Tm to the sub tank Ts when the fuel level 13 is equal to or larger than the certain height. However, when the fuel level 13 is equal to or larger than the certain height, the volume of the gas-phase portion 12 also becomes small and the amount of fuel vapor generated is also small. Thus, even if supplying fuel vapor from the main tank Tm to the sub tank Ts is given up when the fuel level 13 of the main tank Tm is equal to or larger than the certain height, there is no particular problem in practice.

Further, in the first embodiment, the height Hv from the opening portion of the second communication passage P2 in the main tank Tm to the fuel level 13 of the main tank Tm is set to be smaller than the height Hv' from the fuel level 16 of the sub tank Ts to the highest portion of the first communication passage P1. The technical significance of this arrangement is described below.

When the pressure of the gas-phase portion 15 of the sub tank Ts becomes higher than the pressure of the gas-phase portion 12 of the main tank Tm, difference in pressure that can overcome the pressure of a column of fuel with a height of Hv is necessary for supplying fuel vapor of the gas-phase portion 15 of the sub tank Ts to the liquid-phase portion 11 of the main tank Tm via the second communication passage P2. On the other hand, if the pressure difference is larger than the pressure of a column of fuel with a height of Hv', fuel of the liquid-phase portion 14 of the sub tank Ts flows back to the main tank Tm via the first communication passage P1. Therefore, Hv<Hv' is required to be established in order to supply fuel vapor from the sub tank Ts to the main tank Tm via the second communication passage P2 while preventing fuel from flowing from the sub tank Ts back to the main tank Tm via the first communication passage P1.

Even if Hv<Hv' does not hold due to convenience of layout, the same effect as when Hv<Hv' holds can be obtained, because a check valve 37 for regulating the inflow of fuel from the sub tank Ts to the main tank Tm is provided in the first communication passage P1 as shown by a broken line in FIG. 1.

Further, in the case where Hv<Hv' does not hold, when the temperature of the main tank Tm becomes lower than the temperature of the sub tank Ts as the ambient air temperature decreases during the night and fuel in the liquid-phase portion 14 of the sub tank Ts is drawn to the main tank Tm via the first communication passage P1, if the fuel level 16 of the sub tank Ts becomes lower than the opening portion of the first communication passage P1 in the sub tank Ts, it becomes impossible to supply, to the liquid-phase portion 14 of the sub tank Ts, fuel vapor that is supplied from the gas-phase portion 12 of the main tank Tm to the sub tank Ts via the first communication passage P1 when the ambient air temperature increases during the following daytime.

In order to avoid this situation, it is necessary to set the volume of fuel that can be drawn out from the sub tank Ts to the main tank Tm via the first communication passage P1, that is, the volume of fuel that corresponds to the height Hp' of the sub tank Ts, to be larger than the maximum value of the volume of fuel that might be drawn out from the sub tank Ts to the main tank Tm.

As described above, according to the first embodiment, when the temperature of the main tank Tm increases, fuel vapor of the gas-phase portion 12 of the main tank Tm is supplied via the first communication passage P1 to the liquid-phase portion 14 of the sub tank Ts having a lower temperature, and is liquefied therein; and when the temperature of the main tank Tm decreases, fuel vapor of the gas-phase portion 15 of the sub tank Ts is supplied via the second communication passage P2 to the liquid-phase portion 11 of the main tank Tm having a lower temperature, and is liquefied therein. Therefore, the generation of fuel vapor can be effectively suppressed in any temperature conditions of the main tank Tm and the sub tank Ts. As a result, not only can fuel vapor be prevented from diffusing into the atmosphere even when the capacity of the canister C is reduced, but also fuel vapor purged from the canister C into the intake system of the engine can be reduced, thereby improving the accuracy in control of the air-fuel ratio of the engine.

The second embodiment of the present invention is now described by reference to FIG. 2.

As described in the first embodiment, Hv<Hv' is required to be established in order to supply fuel vapor from the sub tank Ts to the main tank Tm via the second communication passage P2 while preventing fuel from flowing from the sub tank Ts back to the main tank Tm via the first communication passage P1. However, since the height Hv changes in response to the fuel level 13 of the main tank Tm going up and down, it is difficult to constantly establish Hv<Hv'.

That is, in order to supply fuel vapor from the gas-phase portion 15 of the sub tank Ts to the liquid-phase portion 11 of the main tank Tm via the second communication passage P2, it is desirable to lower the position of the opening portion of the second communication passage P2 in the main tank Tm as much as possible. However, lowering the position of the opening portion increases the height Hv, thus making it difficult to establish Hv<Hv'. In order to avoid this situation, if the position of the opening portion of the second communication passage P2 in the main tank Tm is raised, there is a problem that the opening portion is exposed above the fuel level 13 when the fuel level 13 goes down, and fuel vapor cannot be supplied to the liquid-phase portion 11.

To solve this problem, in the second embodiment, a fuel tank structure is provided in which a lower portion of a second communication passage P2 branches into a plurality of lines so as to open in a liquid-phase portion 11 of a main tank Tm at positions of different heights. Each branched line is provided with an open/close valve 31. Opening of the open/close valves 31 is selectively controlled corresponding to the height of a fuel level 13 detected by a liquid level meter (not illustrated) provided in a fuel tank T. Specifically, in response to a decrease in the fuel level 13, the open/close valves 31 are sequentially opened from one at a high position to one at a low position. With this arrangement, it is possible to constantly establish Hv<Hv' by constantly maintaining the height Hv at a low level irrespective of a change in the fuel level 13 while making the second communication passage P2 constantly communicate with the liquid-phase portion 11 of the main tank Tm.

Figure 3:
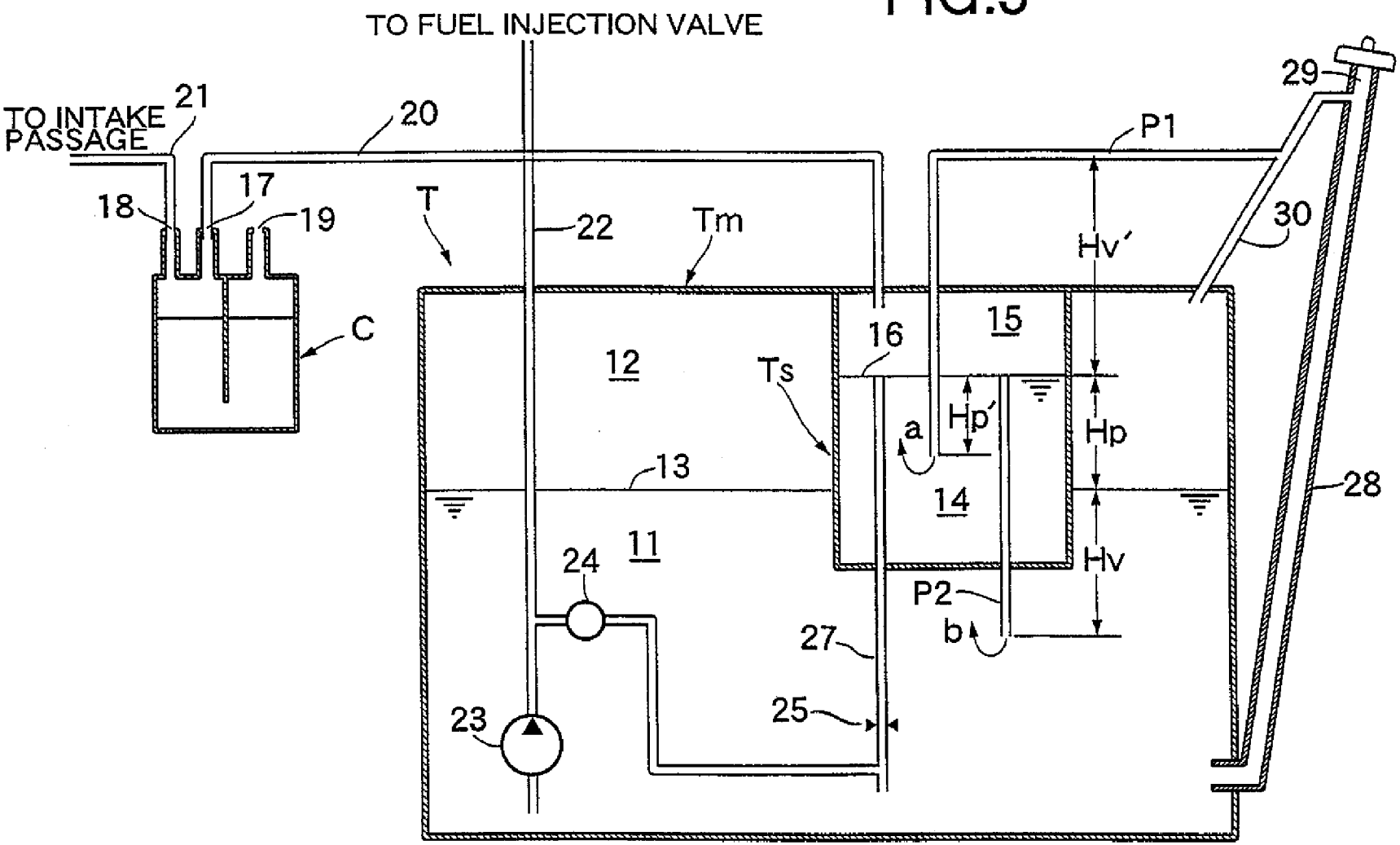
FIG. 3 is a diagram showing a fuel vapor release suppression system for a fuel tank according to a third embodiment.

The third embodiment of the present invention is now described by reference to FIG. 3.

In the first and second embodiments, the sub tank Ts is disposed outside the main tank Tm, but in the third embodiment a sub tank Ts is disposed within a main tank Tm. Disposing the sub tank Ts within the main tank Tm reduces the overall size of the entire fuel tank T, reduces the number of steps in assembling the fuel tank T to a vehicle body, and improves the degree of freedom in the layout. Further, since the sub tank Ts, disposed within the main tank Tm, is not susceptible to the influence of the ambient air temperature, it is not necessary to attach the heat-insulating material 10 to the sub tank Ts, as shown in the first and second embodiments.

Furthermore, it is necessary to make the highest portion of the first communication passage P1 relatively high in order to secure a sufficient height Hv', leading to a problem that the first communication passage P1 inevitably becomes long. To solve such a problem, in the third embodiment, a first communication passage P1 is connected to a portion of a fuel vapor return passage 30 near its upper end, the fuel vapor return passage 30 having a lower end that communicates with a gas-phase portion 12 of the main tank Tm. With this arrangement, the fuel vapor return passage 30 can be used as a part of the first communication passage P1, thereby reducing the overall length of the first communication passage P1.

Figure 4:
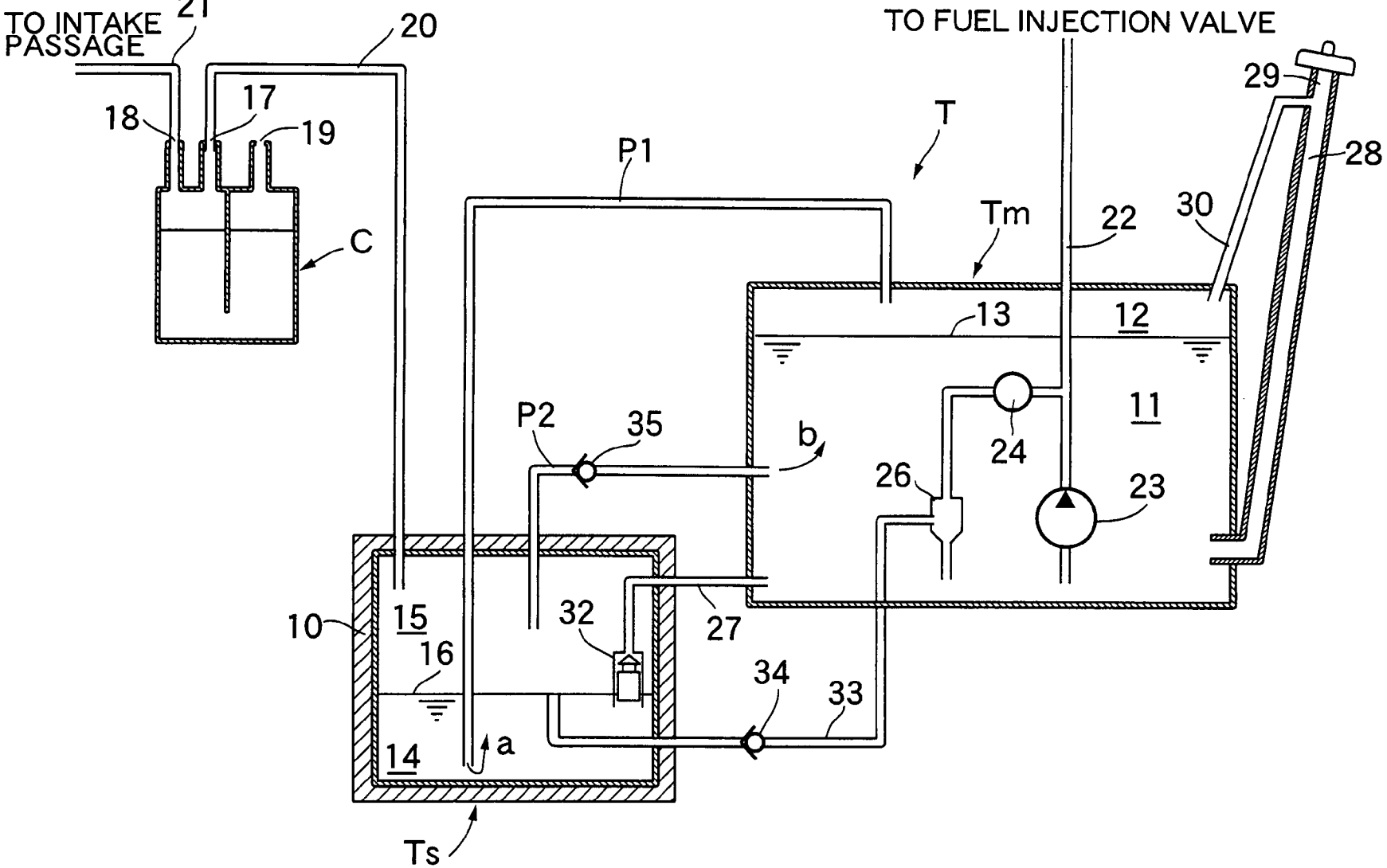
FIG. 4 is a diagram showing a fuel vapor release suppression system for a fuel tank according to a fourth embodiment.

The fourth embodiment of the present invention is now described by reference to FIG. 4.

In the first to third embodiments, the fuel level 16 of the sub tank Ts is higher than the fuel level 13 of the main tank Tm, but in the fourth embodiment a fuel level 16 of a sub tank Ts is lower than a fuel level 13 of a main tank Tm. Thus, it is necessary to employ special means for supplying and discharging fuel between the main tank Tm and the sub tank Ts.

Firstly, supply of fuel from the main tank Tm to the sub tank Ts is carried out by virtue of gravity via a fuel replenishment passage 27. In addition, a float valve 32 is provided in a portion of the fuel replenishment passage 27 where the passage 27 opens in the sub tank Ts, and is configured to obstruct fuel flow through the fuel replenishment passage into the sub tank Ts at a predetermined fuel level so that the fuel level 16 of the sub tank Ts does not increase without restriction. This float valve 32 closes when the fuel level 16 of the sub tank Ts reaches a predetermined height, thus blocking supply of fuel from the main tank Tm to the sub tank Ts.

Further, there is provided a fuel discharge passage 33 for discharging surplus fuel of the sub tank Ts into the main tank Tm. A jet pump 26, which is operated by fuel flowing past a regulator 24, is provided at the exit of the fuel discharge passage 33. Also, the fuel discharge passage 33 is provided with a check valve 34 which only permits flow of fuel from the sub tank Ts to the main tank Tm while preventing fuel from flowing from the main tank Tm back to the sub tank Ts due to gravity when an engine is stopped.

Furthermore, in order to prevent fuel of the main tank Tm from flowing into the sub tank Ts due to gravity, a check valve 35 for only permitting flow of fuel vapor from the sub tank Ts to the main tank Tm is provided in an intermediate portion of a second communication passage P2 which provides communication between a gas-phase portion 15 of the sub tank Ts and a liquid-phase portion 11 of the main tank Tm.

That is, in the first to third embodiments surplus fuel that has passed the regulator 24 is supplied from the main tank Tm to the sub tank Ts, but in the fourth embodiment fuel is supplied from the main tank Tm to the sub tank Ts by virtue of gravity. Further, in the first to third embodiments fuel is returned from the main tank Tm to the sub tank Ts by virtue of gravity via the second communication passage P2, but in the fourth embodiment fuel of the sub tank Ts is drawn up by means of the jet pump 26, which is operated by surplus fuel that has passed the regulator 24, and returned to the main tank Tm. According to the fourth embodiment, it is possible to increase the degree of freedom in layout by making the position of the sub tank Ts lower than the position of the main tank Tm while providing the same operational effect as those of the first to third embodiments.

Figure 5:
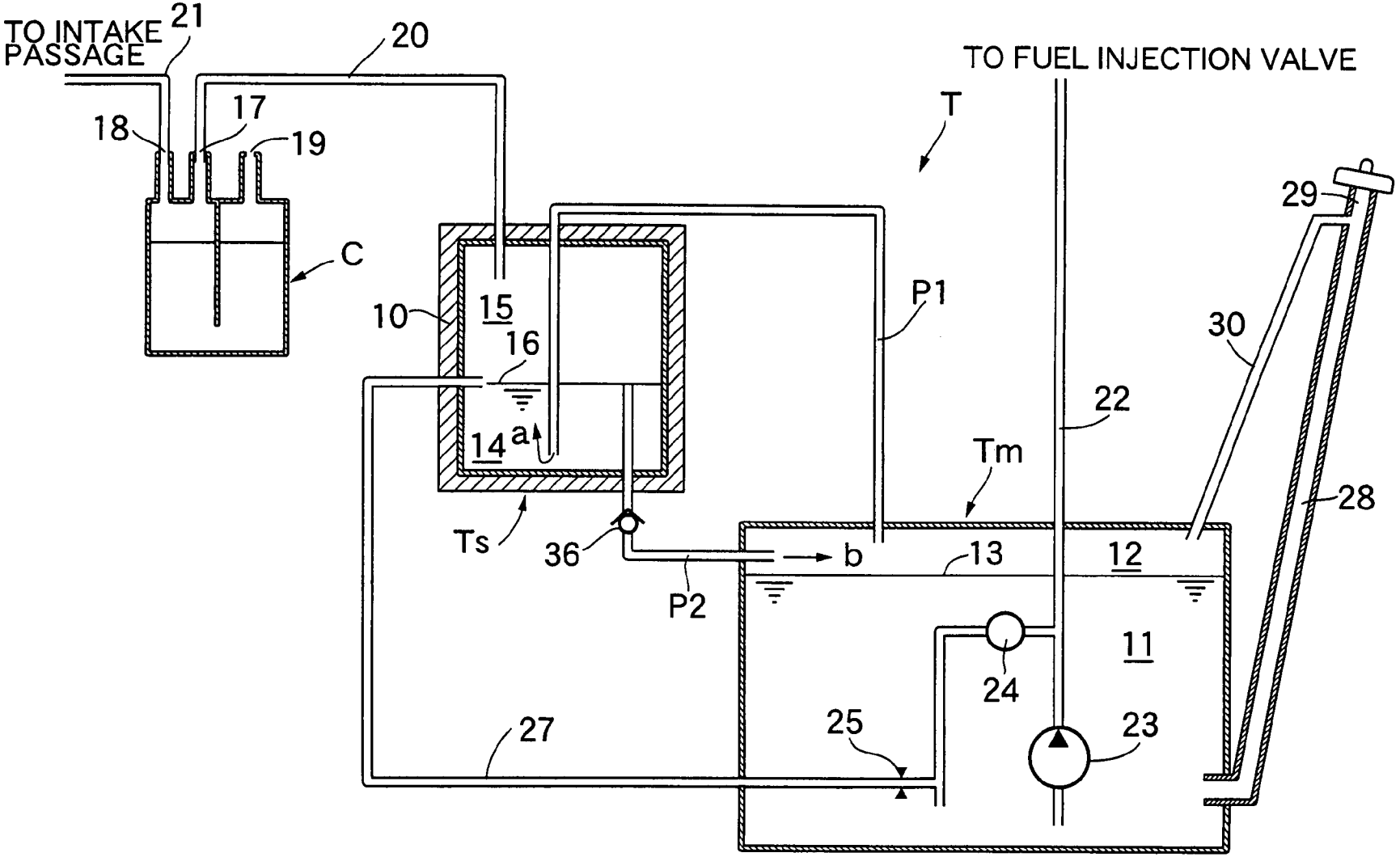
FIG. 5 is a diagram showing a fuel vapor release suppression system for a fuel tank according to a fifth embodiment.

The fifth embodiment of the present invention is now described by reference to FIG. 5.

The fifth embodiment is a modification of the first embodiment. The second communication passage P2 of the first embodiment communicates with the liquid-phase portion 11 of the main tank Tm, but a second communication passage P2 of the fifth embodiment communicates with a gas-phase portion 12 of a main tank Tm. In order to prevent fuel vapor from flowing from the gas-phase portion 12 of the main tank Tm back to a gas-phase portion 15 of a sub tank Ts, a check valve 36 for only allowing flow of fuel vapor from the sub tank Ts to the main tank Tm is provided in the second communication passage P2.

According to the fifth embodiment, fuel vapor of the gas-phase portion 15 of the sub tank Ts, which has a higher temperature when the ambient air temperature decreases during night, etc., is supplied to the gas-phase portion 12 rather than the liquid-phase portion 11 of the main tank Tm which has a lower temperature. Then, the fuel vapor is cooled in the gas-phase portion 12 of the main tank Tm and liquefies, providing the same operational effect as that of the first embodiment.

Although embodiments of the present invention have been described above, the present invention is not limited to the above-described embodiments, and various modifications in design can be made to the present invention without departing from the subject matter thereof.

For example, the sub tank Ts may be covered with a heat-storing material or a vacuum heat-insulating layer, instead of the heat-insulating material 10. That is, any means for suppressing heat transfer is applied to the whole or part of the surface of the sub tank Ts.

Figure 2:
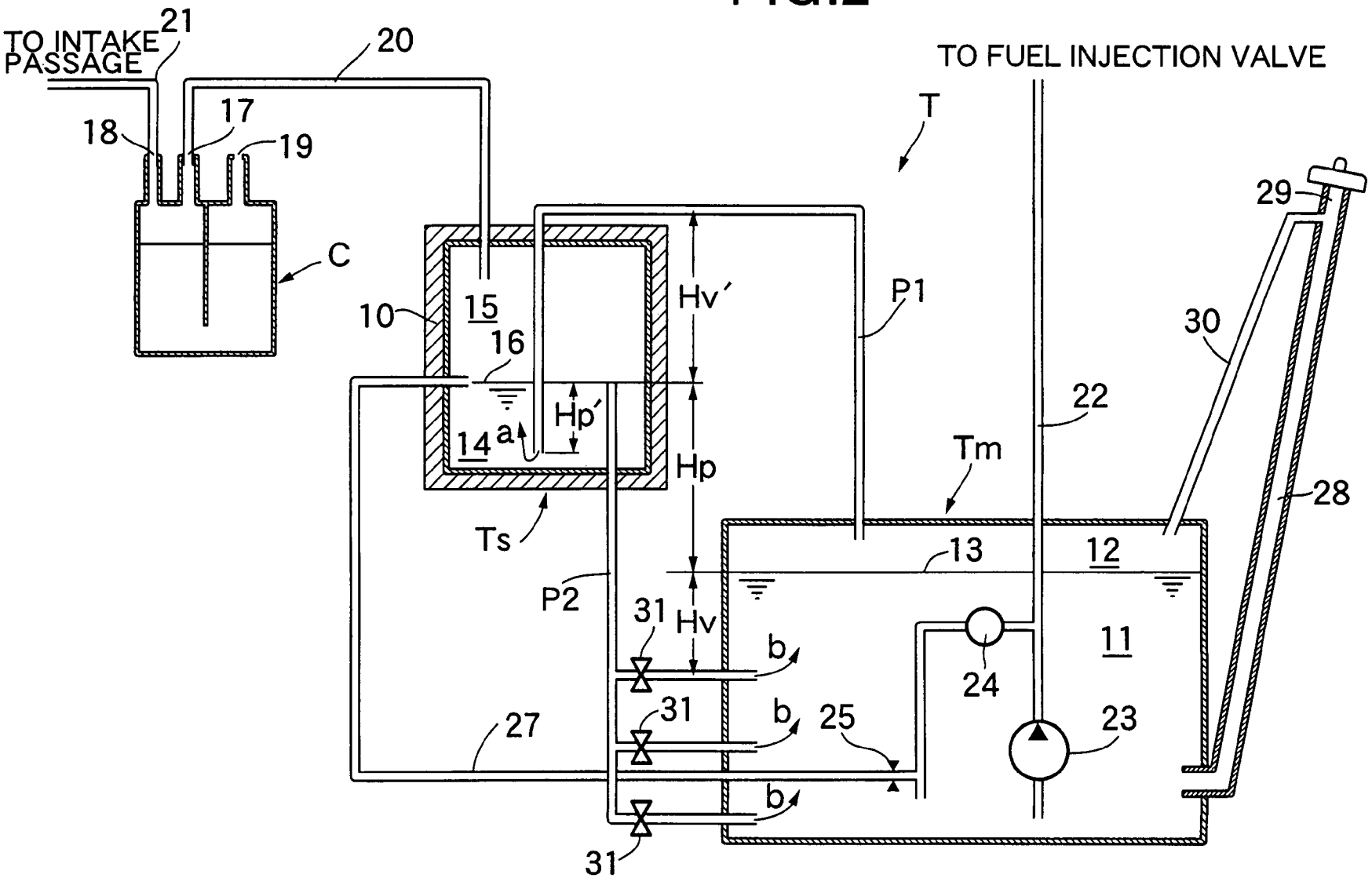
FIG. 2 is a diagram showing a fuel vapor release suppression system for a fuel tank according to a second embodiment.

Further, as a modification example of the second embodiment shown in FIG. 2, a flexible tube is connected to an end of the second communication passage P2 and attached to a float disposed in the main tank Tm so that the tip end of the flexible tube is constantly positioned slightly beneath the fuel level 13 by the float that follows change of the fuel level 13. With this arrangement, the height Hv is constantly maintained to be low irrespective of the change of the fuel level 13, thereby constantly establishing Hv<Hv'.

What is claimed is:

1. A fuel vapor release suppression system for a fuel tank, said vapor release suppression system comprising:

a main tank;

a sub tank, wherein a liquid level of the sub tank is set to be different disposed at a different height from a liquid level of the main tank when the main tank is full;

at least one communication passage providing communication between the main tank and the sub tank;

a canister; and a charge passage providing communication between the sub tank and the canister, wherein the at least one communication passage comprises:

a first communication passage providing communication between a gas-phase portion of the main tank and a liquid-phase portion of the sub tank; and a second communication passage providing communication between a gas-phase portion of the sub tank and a liquid-phase portion of the main tank.

2. The fuel vapor release suppression system for a fuel tank according to claim 1, wherein the sub tank has a structure comprising a rate of heat transfer that is lower than that of the main tank.

3. The fuel vapor release suppression system for a fuel tank according to claim 2, wherein at least a part of the sub tank is covered by any one of a heat-insulating material, a heat-storing material, and a vacuum heat-insulating layer.

4. The fuel vapor release suppression system for a fuel tank according to claim 2, wherein the sub tank is disposed in the interior of the main tank.

5. The fuel vapor release suppression system for a fuel tank according to claim 1, wherein a fuel level of the sub tank is set to be higher than a fuel level of the main tank; and a height from the fuel level of the main tank to the fuel level of the sub tank is set to be larger than a height at which the first communication passage is submerged under the fuel level of the sub tank.

6. The fuel vapor release suppression system for a fuel tank according to claim 5, wherein the fuel level of the main tank is a full tank leve2l.

7. The fuel vapor release suppression system for a fuel tank according to claim 1, wherein the fuel level of the sub tank is set to be higher than the fuel level of the main tank; and a height from an opening portion of the second communication passage in the main tank to the fuel level of the main tank is set to be smaller than a height from the fuel level of the sub tank to the highest portion of the first communication passage.

8. The fuel vapor release suppression system for a fuel tank according to claim 1, wherein the fuel level of the sub tank is set to be higher than the fuel level of the main tank; a height from an opening portion of the second communication passage in the main tank to the fuel level of the main tank is allowed to become larger than a height from the fuel level of the sub tank to the highest portion of the first communication passage; and the first communication passage comprises a check valve for restricting inflow of fuel from the sub tank to the main tank.

9. The fuel vapor release suppression system for a fuel tank according to claim 7, wherein height of the opening portion of the second communication passage in the main tank is made variable.

10. The fuel vapor release suppression system for a fuel tank according to claim 1, wherein volume of the sub tank between an opening portion of the first communication passage in the sub tank and the opening portion of the second communication passage is set to be larger than volume for drawing out fuel from the sub tank to the main tank via the first communication passage.

11. The fuel vapor release suppression system for a fuel tank according to claim 1, wherein a filler tube extending upward from the main tank is connected, at a portion near a filler hole provided at an upper end of the filler tube, to the gas-phase portion of the main tank via a fuel vapor return passage; and the first communication passage is connected to the fuel vapor return passage.

12. The fuel vapor release suppression system for a fuel tank according to claim 1, wherein fuel in the sub tank is replenished via a fuel replenishment passage with at least a part of surplus fuel supplied from the main tank to an engine.

13. The fuel vapor release suppression system for a fuel tank according to claim 1, wherein a fuel level of the sub tank is set to be lower than a fuel level of the main tank; and the fuel vapor release suppression system further comprises:

a first check valve that is provided in the second communication passage and restricts inflow of fuel from the main tank to the sub tank, a float valve that is provided at an exit of a fuel replenishment passage for supplying fuel from the main tank to the sub tank and restricts an upper limit of the fuel level of the sub tank, a jet pump that is operated by surplus fuel supplied from the main tank to an engine, a fuel discharge passage that draws up surplus fuel from the sub tank to the main tank by means of the jet pump, and a second check valve that is provided in the fuel discharge passage and restricts the inflow of fuel from the main tank to the sub tank.

14. The fuel vapor release suppression system for a fuel tank according to claim 1, wherein the sub tank comprises a volume which is smaller than a volume of the main tank.

15. The fuel vapor release suppression system for a fuel tank according to claim 1, wherein the sub tank is disposed at a position higher than that of the main tank.

16. The fuel vapor release suppression system for a fuel tank according to claim 13, wherein the sub tank is disposed at a position lower than that of the main tank.

17. The fuel vapor release suppression system for a fuel tank according to claim 13, wherein a replenishing supply of fuel from the main tank to the sub tank is achieved via gravity through the fuel replenishment passage.

18. The fuel vapor release suppression system for a fuel tank according to claim 1, wherein the canister is configured to adsorb fuel vapor.

19. The fuel vapor release suppression system for a fuel tank according to claim 1, wherein a lower portion of the second communication passage branches into plural subpassages such that each subpassage provides communication between the gas phase portion of the sub tank and the liquid-phase portion of the main tank, and each subpassage opens into the main tank at a unique height, and each subpassage comprises a valve, whereby the valves are individually controlled such that the height of the opening portion of the second communication passage in the main tank is varied according to fuel level height of the main tank.

20. A fuel vapor release suppression system for a fuel tank, said vapor release suppression system comprising:

a main tank;

a fuel pump disposed in the main tank;

a sub tank, wherein a liquid level of the sub tank is set to be disposed at a different height from a liquid level of the main tank when the main tank is full;

at least one communication passage providing communication between the main tank and the sub tank;

a canister; and a charge passage providing communication between the sub tank and the canister, wherein the at least one communication passage comprises:

a first communication passage providing communication between a gas-phase portion of the main tank and a liquid-phase portion of the sub tank; and a second communication passage providing communication between a gas-phase portion of the sub tank and a liquid-phase portion of the main tank; and a replenishment passage extending from the main tank to the sub tank and in fluid communication with the fuel pump for selectively replenishing the liquid level of the sub tank, wherein the replenishment passage has an outlet in the sub tank which is disposed proximate the liquid level of the sub tank.

21. A fuel vapor release suppression system for a fuel tank, said vapor release suppression system comprising:

a main tank;

a sub tank, wherein a liquid level of the sub tank is set to be disposed at a different height from a liquid level of the main tank when the main tank is full;

at least one communication passage providing communication between the main tank and the sub tank;

a canister; and a charge passage providing communication between the sub tank and the canister, wherein the at least one communication passage comprises:

a first communication passage providing communication between a gas-phase portion of the main tank and a liquid-phase portion of the sub tank; and a second communication passage providing communication between a gas-phase portion of the sub tank and a gas-phase portion of the main tank, and wherein the second communication passage comprises a check valve for preventing fuel vapor from flowing from the gas-phase portion of the main tank back to the gas-phase portion of the sub tank.

* * * * *